US008042244B2

(12) United States Patent
Lai

(10) Patent No.: US 8,042,244 B2
(45) Date of Patent: Oct. 25, 2011

(54) BEARING ADJUSTER

(76) Inventor: Jin-Tsai Lai, Taichung Hsien (TW)

( * ) Notice: Subject to any disclaimer, the term of this patent is extended or adjusted under 35 U.S.C. 154(b) by 431 days.

(21) Appl. No.: 12/346,760

(22) Filed: Dec. 30, 2008

(65) Prior Publication Data

US 2010/0162547 A1 Jul. 1, 2010

(51) Int. Cl.
*B25B 27/14* (2006.01)
*B25B 1/00* (2006.01)

(52) U.S. Cl. ..... 29/275; 29/274; 269/3; 269/6

(58) Field of Classification Search ..... 29/33 R, 29/271, 270, 281.6, 771, 813, 802, 221.5, 29/269, 273, 274, 278, 281.1, 275; 269/3, 269/6

See application file for complete search history.

(56) References Cited

U.S. PATENT DOCUMENTS 3,956,801 A * 5/1976 Wood ..... 29/725
4,575,929 A * 3/1986 Bleeke ..... 29/620

* cited by examiner

*Primary Examiner* — Monica Carter
*Assistant Examiner* — Seahee Yoon

(57) ABSTRACT

A bearing adjuster includes a grip. A rotatable wheel is mounted with the grip. The rotatable wheel has a through hole centrally defined therein. The rotatable wheel has multiple arc grooves spirally and concentrically defined in a bottom thereof. An adjusting member has spindle extending from a top thereof. The spindle is connected to grip via the through hole in the rotatable wheel. The adjusting member has multiple grooves radially defined therein for corresponding to the multiple arc grooves. Each groove has a movable member movably received therein. Each movable member has a stub extended form a top thereof to be received in a corresponding one arc groove in the rotatable wheel.

5 Claims, 7 Drawing Sheets

BEARING ADJUSTER

BACKGROUND OF THE INVENTION

1. Field of the Invention

The present invention relates to an adjuster, and more particularly to a bearing adjuster.

2. Description of Related Art

A conventional bearing adjuster includes a grip having an inner end fixed with a combining rod with a combining hole. One or more positioning press blocks to be fitted with the grip are respectively formed with different diameters and bored with a central insert hole and respectively formed with a first fitting member, a first holding edge, a second fitting member and a second holding edge. A combining member is combined with the combining hole of a grip. By having the fitting member and the holding edge of the positioning press block respectively contacting closely with the inner wall and the upper edge of the conventional bearing, hammering force can be applied evenly to position smoothly and quickly the bearing in the insert hole of an axle.

However, the conventional bearing adjuster is inconvenient due to the positioning press block of the conventional bearing adjuster is necessary to be replaced with a positioning press block having different diameter. In particular, it is very inconvenient that a user should carry a numerous of positioning press blocks for suiting different requirements.

Furthermore, when assembling to a huge mechanism, it is usually required an amount of the conventional bearing adjuster and a numerous of positioning press blocks.

The present invention has arisen to mitigate and/or obviate the disadvantages of the conventional bearing adjuster.

SUMMARY OF THE INVENTION

The main objective of the present invention is to provide an improved bearing adjuster.

To achieve the objective, the bearing adjuster in accordance with the present invention comprises a grip including an impact receiver disposed thereon to provide for receiving impact form external forces. A rotatable wheel is mounted with the grip. The rotatable wheel has a through hole centrally defined therein. The rotatable wheel has a handle disposed on a top thereof The handle has multiple recesses equidistantly radially defined in an outer periphery thereof to provide a grasp effect for a user. The rotatable wheel has multiple arc grooves spirally and concentrically defined in a bottom thereof A top of the rotatable wheel has multiple scales disposed on an edge thereof The bottom of the rotatable wheel has multiple notches defined in an edge thereof and respectively corresponding to the multiple scales. An adjusting member has spindle extending from a top thereof The spindle is connected to grip via the through hole in the rotatable wheel. The adjusting member has an inserting slot laterally defined therein. The adjusting member has multiple grooves radially defined therein for corresponding to the multiple arc grooves. Each groove in the adjusting member has two ribs respectively formed on two inside thereof Each groove has a movable member movably received therein. Each movable member has two sliding slots respectively defined in two lateral sides thereof for corresponding to the two ribs of the groove such that the each movable member is slidably received in a corresponding groove in the adjusting member. Each movable member has a stub extended form a top thereof to be received in a corresponding one arc groove in the rotatable wheel. A position member is partially received in the inserting slot and disposed on a lateral of the rotatable wheel.

The position member has a V-shaped inserter laterally extended from a bottom thereof for partially receiving in the inserting slot. The inserter has a position rib extended from a distal end thereof for positioning in the inserting slot. The position member has an indicator disposed on a top thereof for cooperatively corresponding to the scales of the rotatable wheel. The position member having a position groove laterally defined in a middle thereof and being adjacent to the inserter for complementally receiving the edge of the rotatable wheel, the position member having a protrusion extended from an inner periphery of the position groove for corresponding to the notches of the rotatable wheel.

The rotatable wheel is rotatable relative to the grip and the adjusting member. When the rotatable wheel is rotated, the stub of each movable is pressed by the corresponding arc groove to move along the corresponding groove in the adjusting member such that each movable member is moved relative to each other along the corresponding groove in the adjusting member for adjusting a distance between each other for adjusting a distance between each other for adapted to assemble with bearings having different sizes.

Further benefits and advantages of the present invention will become apparent after a careful reading of the detailed description with appropriate reference to the accompanying drawings.

DETAILED DESCRIPTION OF THE INVENTION

Figure 1:
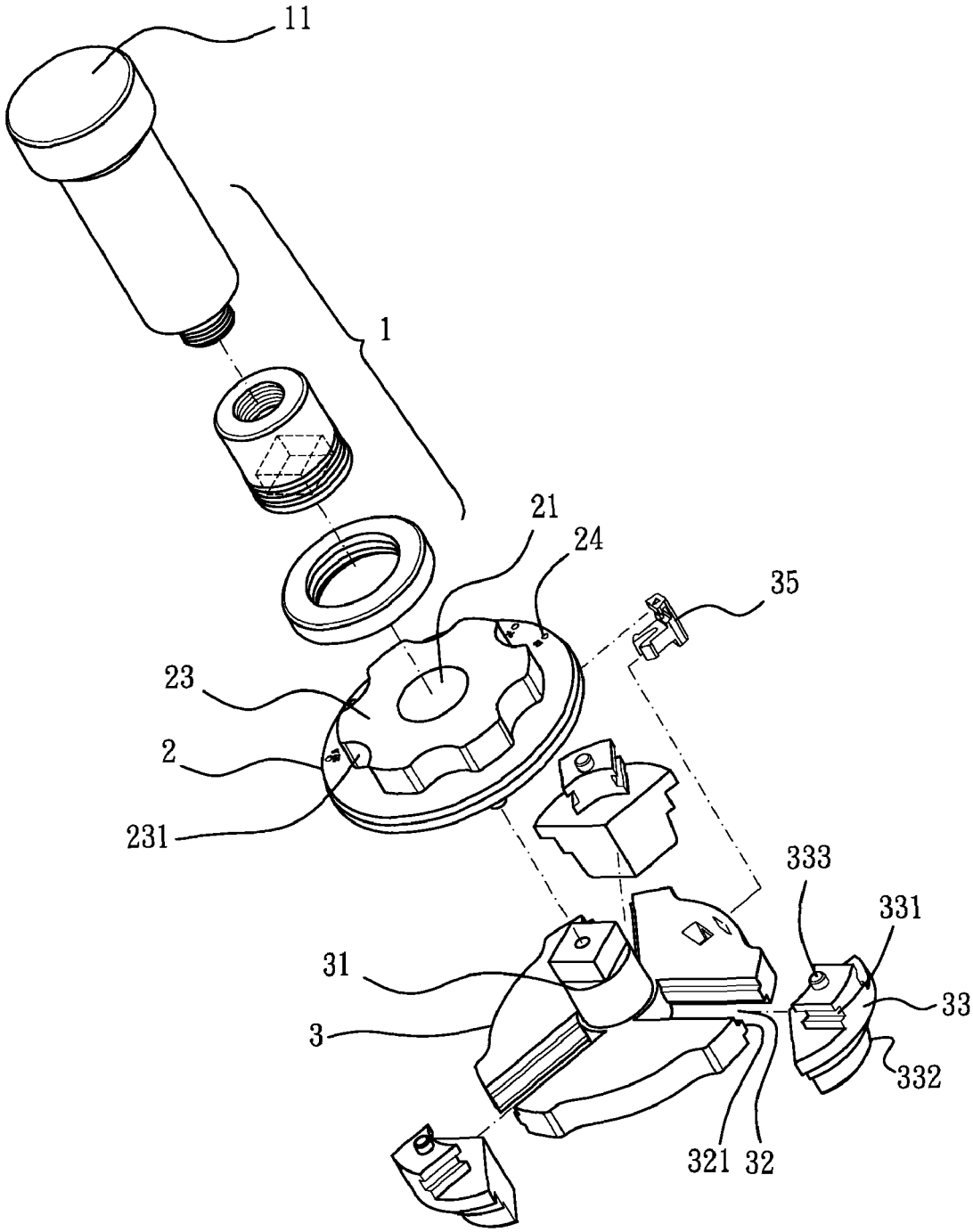
FIG. 1 is an exploded perspective view of a bearing adjuster in accordance with the present invention.
Figure 2:
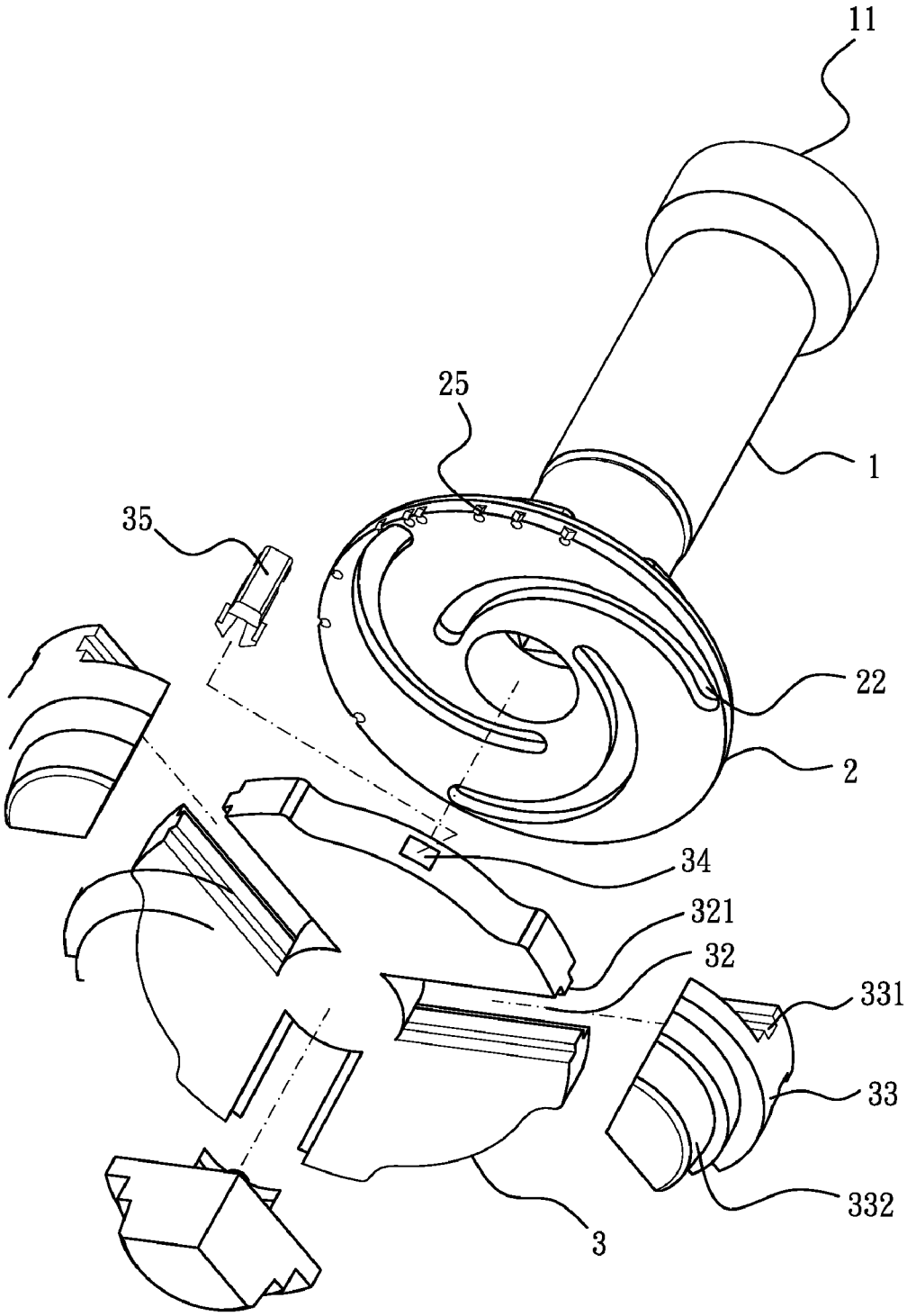
FIG. 2 is an exploded perspective view of the bearing adjuster in accordance with the present invention in another direction.
Figure 3:
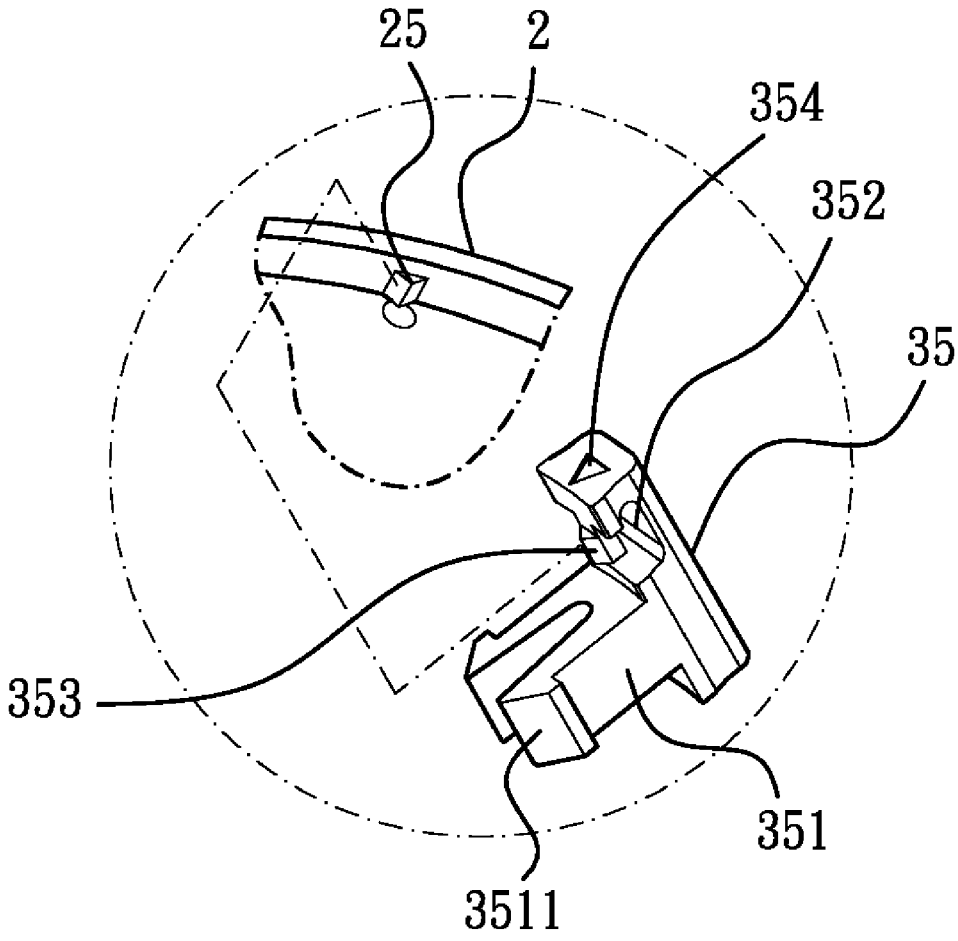
FIG. 3 is a partial enlarged perspective view of a position member in FIG. 2 in another direction.
Figure 4:
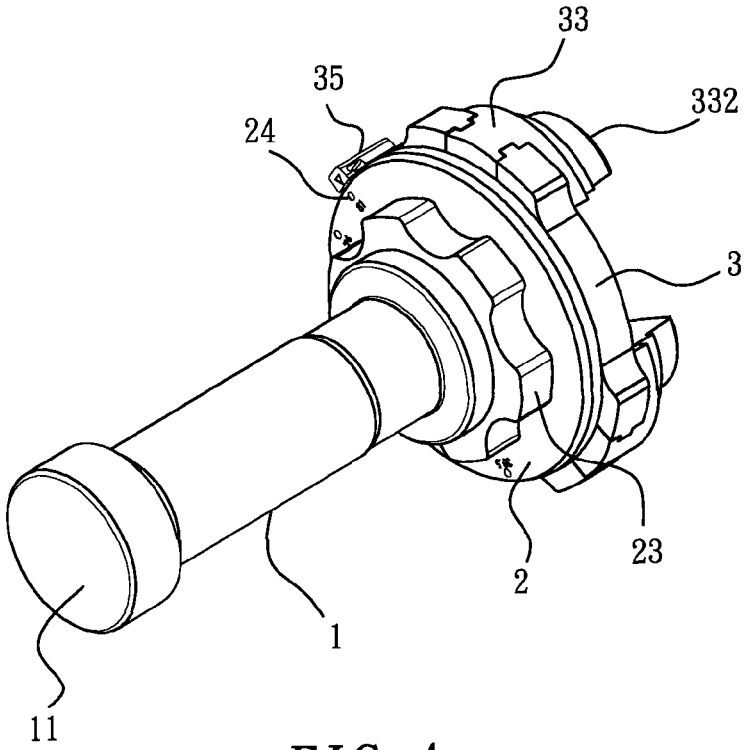
FIG. 4 is an assembled perspective view of the bearing adjuster in accordance with the present invention.
Figure 5:
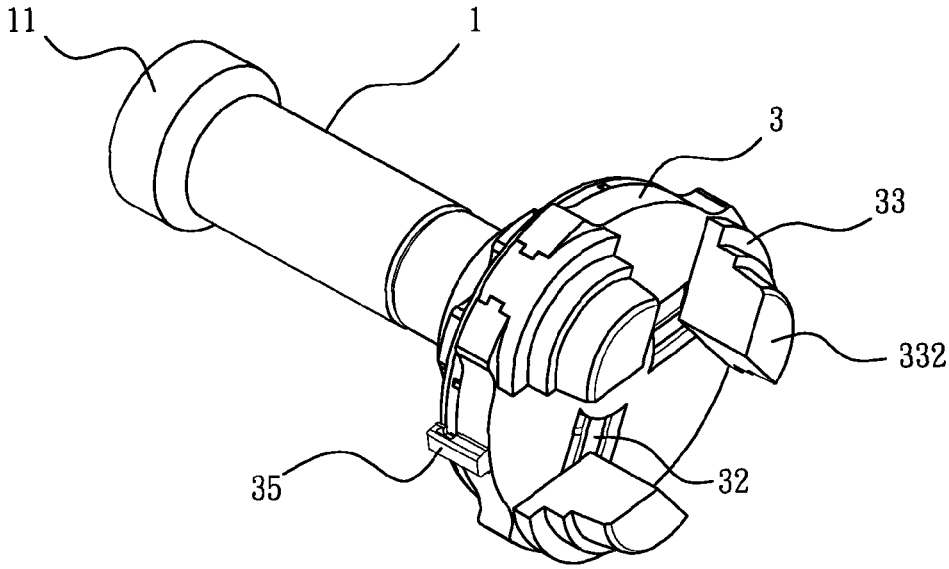
FIG. 5 is an assembled perspective view of the bearing adjuster in accordance with the present invention in another direction.
Figure 6:
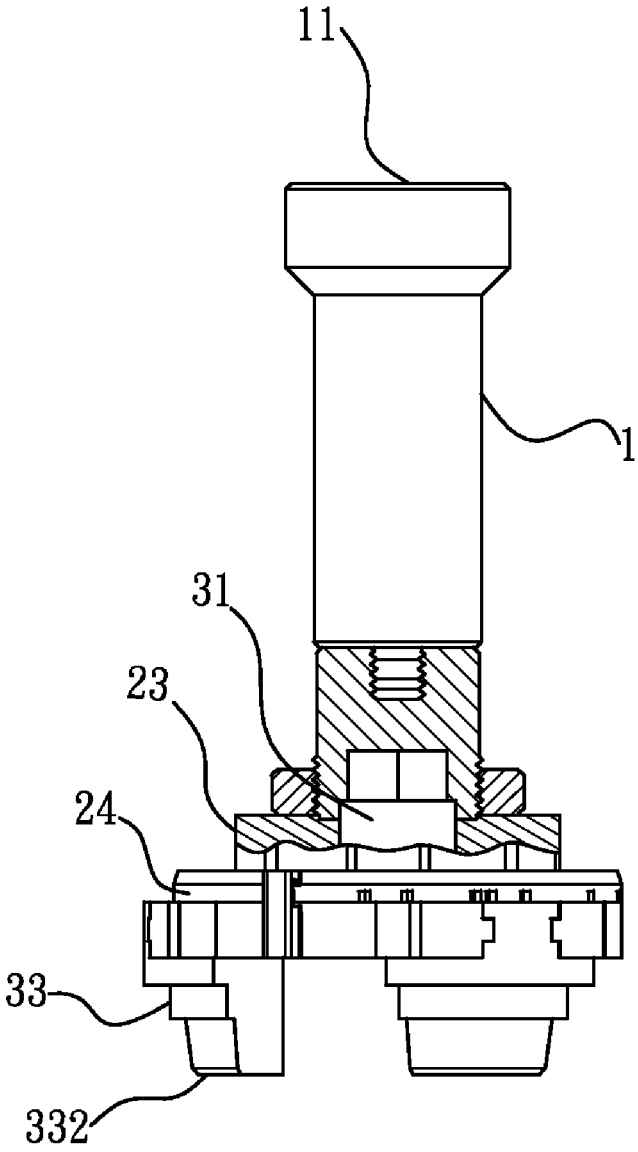
FIG. 6 is a side plan view of the bearing adjuster in accordance with the present invention in another direction.

Referring to the drawings and initially to FIGS. 1-6, a bearing adjuster in accordance with the present invention comprises an adjuster member (3), a rotatable wheel (2) rotatably mounted on the adjuster member (3), and a grip (1) mounted on the rotatable wheel (2).

The grip (1) includes a connecting ring, a base mounted on the rotatable wheel (2) via the connecting ring, and an impact receiver (11) mounted on the base. The impact receiver (11) is provided for receiving impacts from external forces. The base has a hole defined in a bottom thereof.

The rotatable wheel (2) is rotatable relative to the grip (1) and the adjuster member (3). The rotatable wheel (2) has a through hole (21) centrally defined therein. The base is partially received in the through hole (21) in the rotatable wheel (2) and connected to the adjuster member (3). The rotatable wheel (2) has a handle (23) disposed on a top thereof. The handle (23) has multiple recesses (231) equidistantly radially defined in an outer periphery thereof to provide a grasp effect for a user. The rotatable wheel (2) has multiple arc grooves (22) spirally and concentrically defined in a bottom thereof. The top of the rotatable wheel (2) has multiple scales (24) disposed on an edge thereof. The bottom of rotatable wheel (2) has multiple notches (25) defined in an edge thereof and respectively corresponding to the multiple scales (24).

The adjuster member (3) has a spindle (31) extending from a top thereof. The spindle (31) is partially received in the hole in the base of the grip (1) via the through hole (21) in the rotatable wheel (2) for connecting to the rotatable wheel (2). The adjuster member (3) has multiple grooves (32) radially defined therein and corresponding to the multiple arc grooves (22). Each groove (32) has two ribs (321) respectively formed on two inside thereof. Each groove (32) has a movable member (33) movably received therein. Each movable member (33) has a stub (333) extended form a top thereof to be received in a corresponding one arc groove (22) in the rotatable wheel (2). Each movable member (33) has a taped face (332) formed on a bottom thereof. Each movable member (33) has two sliding slots (33 1) respectively defined in two lateral sides thereof for corresponding to the two ribs (321) of the groove (32) in the adjuster member (3) such that each movable member (33) is slidably received in a corresponding groove (32) in the adjuster member (3). The adjuster member (3) has an inserting slot (34) laterally defined therein and positioned between two grooves (32). A position member (35) is laterally disposed on a lateral of the rotatable wheel (2). The position member (35) has a V-shaped inserter (351) laterally extended from a bottom thereof for receiving in the inserting slot (34). The inserter (351) has a position rib (3511) extended from a distal end thereof for positioning the inserter (351) in the inserting slot (34). The position member (35) has an indicator (354) disposed on a top thereof for cooperatively corresponding to the scales (24) of the rotatable wheel (2). The position member (35) has a position groove (352) laterally defined in a middle thereof and being adjacent to the inserter (351) for complementally receiving the edge of the rotatable wheel (2). A protrusion (353) is extended from an inner periphery of the position groove (352) for corresponding to the notches (25) of the rotatable wheel (2).

When assembling, the impact receiver (11) is mounted on the base. The base is screwed into the through hole (21) in the rotatable wheel (2) via the connecting ring. The spindle (31) of the adjuster member (3) is partially received in the hole of the base via the through hold of the rotatable wheel (2). Each movable member (33) is slidably received in the corresponding groove (32) in the adjuster member (3). The stub (333) of the each movable member (33) is movably received in the corresponding arc groove (22) in the rotatable wheel (2). The inserter (351) of the position member (35) is received in the inserting slot (34). The edge of the rotatable wheel (2) is received in the position groove (352) and the protrusion (353) of the position member (35) is received in the notch (25) of the rotatable wheel (2).

Figure 7:
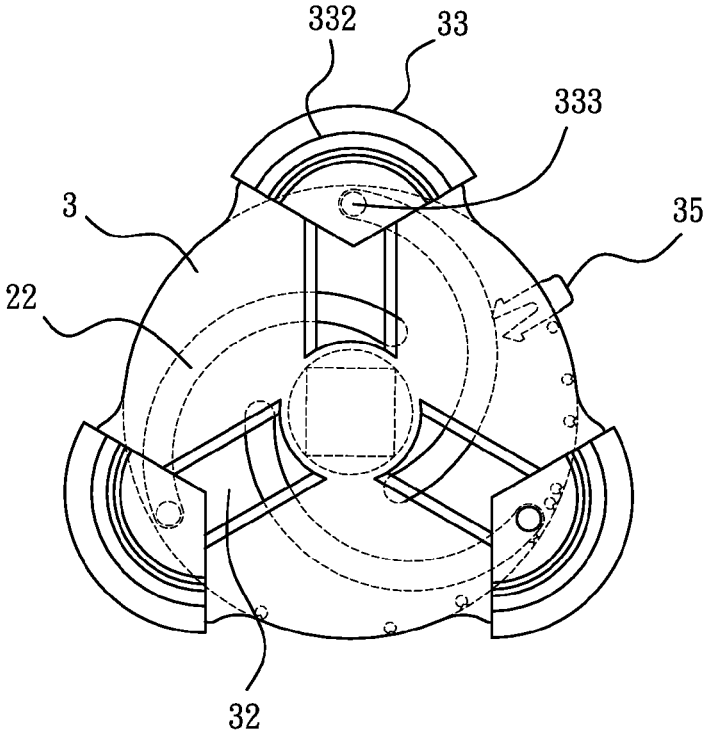
FIGS. 7-8 are operational side plan views of the bearing adjuster in accordance with the present invention.
Figure 8:
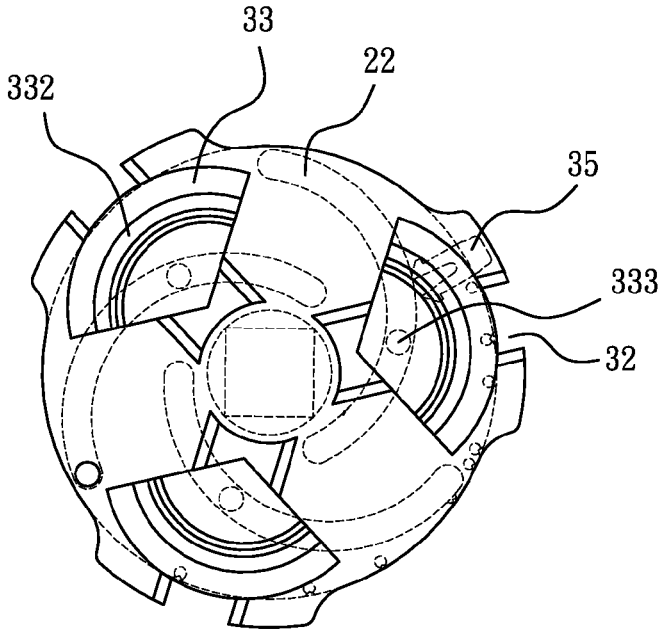
Figure 9:
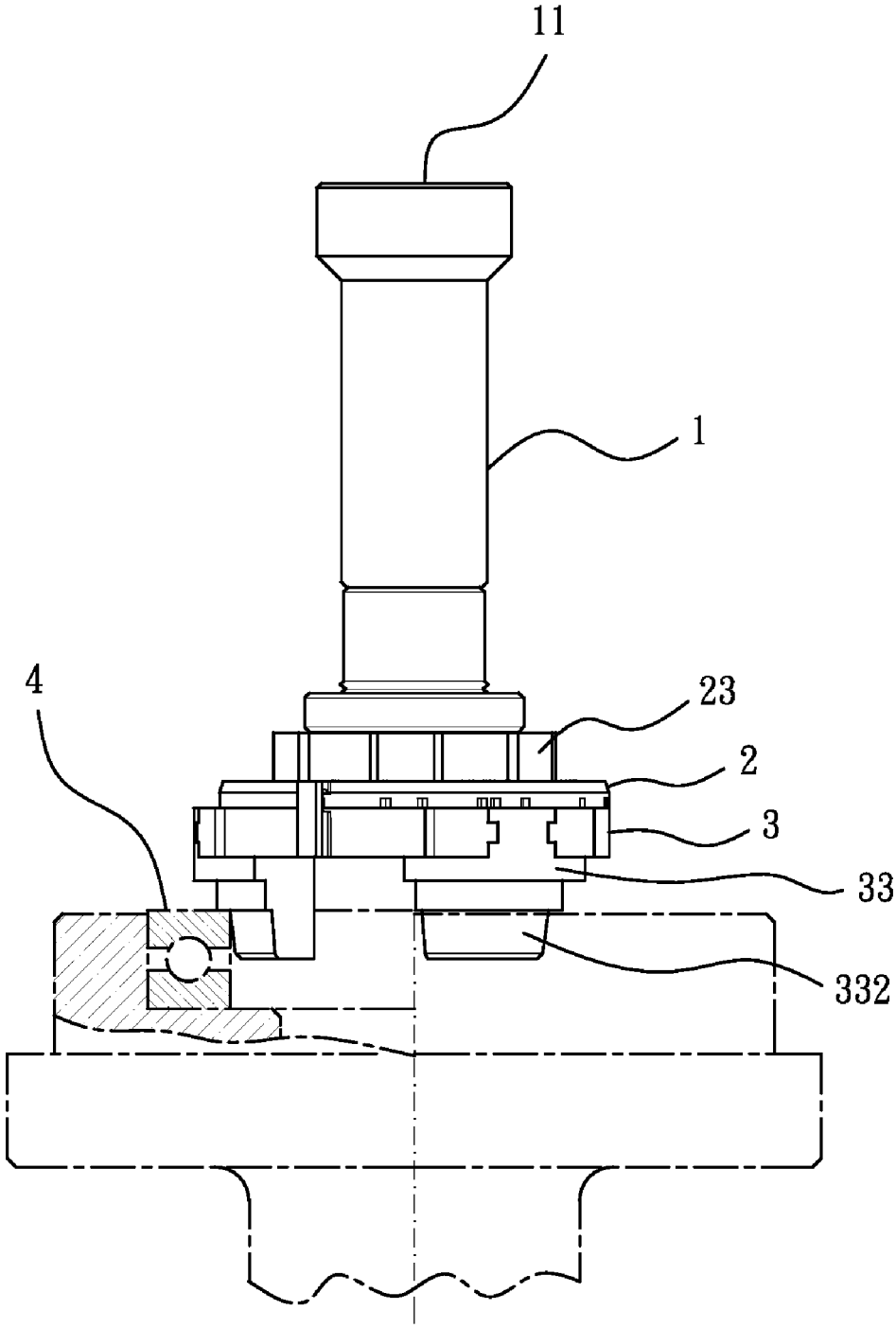
FIG. 9 is a schematic view of the bearing adjuster in accordance with the present invention when assembling in a bearing.

With reference to FIGS. 7-9, the rotatable wheel (2) is rotated relative to the adjuster member (3) to adjust a size of the bearing adjuster in accordance of the present invention for connecting to a bearing (4). When the rotatable wheel (2) is rotated, the stub (333) of each movable member (33) is pressed by the corresponding arc groove (22) to move along the corresponding arc groove (22) such that each movable member (33) is slidingly moved along the corresponding groove (32) for adjusting a distance between each other for suiting the bearings (4) having different sizes. The taped face (332) of each movable member (33) is provided for sliding abutting against an inner periphery of the bearing (4) to easily assemble with the bearing (4).

When the rotatable wheel (2) is rotated along the position groove (352) of the position member (35), the protrusion (353) of the position member (35) is detached form the notch (25) and then received in next notch (25) such that the indicator (354) indicates the scale (24) for showing the size of the bearing (4).

Although the invention has been explained in relation to its preferred embodiment, it is to be understood that many other possible modifications and variations can be made without departing from the spirit and scope of the invention as hereinafter claimed.

What is claimed is:

1. A bearing adjuster comprising:

a grip including an impact receiver disposed thereon to provide for receiving impact from external forces;

a rotatable wheel mounted with the grip, the rotatable wheel having a through hole centrally defined therein, the rotatable wheel having multiple arc grooves spirally and concentrically defined in a bottom thereof, a top of the rotatable wheel having multiple scales disposed on an edge thereof, the bottom of the rotatable wheel having multiple notches defined in an edge thereof and respectively corresponding to the multiple scales, the adjusting member having an inserting slot laterally defined therein, a position member partially received in the inserting slot and disposed on a lateral side of the rotatable wheel, the position member having a protrusion extended therefrom for corresponding to the notches of the rotatable wheel, the position member having an indicator disposed on a top thereof for cooperatively corresponding to the scales of the rotatable wheel; and an adjusting member having a spindle extending from a top thereof, the spindle connected to the grip via the through hole in the rotatable wheel, the adjusting member having multiple grooves radially defined therein for corresponding to the multiple arc grooves, each of the multiple grooves having a movable member movably received therein, each movable member having a stub extended from a top thereof and received in a corresponding one of the multiple arc grooves in the rotatable wheel;

wherein the rotatable wheel is rotatable relative to the grip and the adjusting member; when the rotatable wheel is rotated, the stub of each movable member is pressed by the corresponding arc groove to move along the corresponding groove in the adjusting member such that each movable member is moved along the corresponding groove in the adjusting member for adjusting a distance between each other for being adapted to assemble with bearings having different sizes.

2. The bearing adjuster as claimed in claim 1, wherein the top of the rotatable wheel has the multiple scales disposed on the edge thereof, the bottom of the rotatable wheel having the multiple notches defined in the edge thereof and respectively corresponding to the multiple scales, the adjusting member having the inserting slot laterally defined therein, the position member partially received in the inserting slot and disposed on the lateral side of the rotatable wheel and the adjusting member, the position member having a V-shaped inserter laterally extended from a bottom thereof for partially receiving in the inserting slot, the inserter having a position rib extended from a distal end thereof for positioning in the inserting slot, the position member having the indicator disposed on a top thereof for cooperatively corresponding to the scales of the rotatable wheel, the position member having a position groove laterally defined in a middle thereof and being adjacent to the inserter for complementally receiving the edge of the rotatable wheel, the position member having the protrusion extended from an inner periphery of the position groove for corresponding to the notches of the rotatable wheel.

3. The bearing adjuster as claimed in claim 1, wherein each groove of the adjusting member has two ribs respectively formed on two inside sides thereof, each movable member having two sliding slots respectively defined in two lateral sides thereof for corresponding to the two ribs of the groove; wherein each movable member is slidably received in a corresponding groove of the adjusting member.

4. The bearing adjuster as claimed in claim 1, wherein the rotatable wheel has a handle disposed on a top thereof, the handle having multiple recesses equidistantly radially defined in an outer periphery thereof to provide a grasp effect for a user.

5. The bearing adjuster as claimed in claim 1, wherein each movable member has a taped face formed on a bottom thereof for slidably abutting against an inner periphery of the bearing to easily assemble with the bearing.

* * * * *